United States Patent [19]

Huang et al.

[11] Patent Number: 4,662,441

[45] Date of Patent: May 5, 1987

[54] HORIZONTAL WELLS AT CORNERS OF VERTICAL WELL PATTERNS FOR IMPROVING OIL RECOVERY EFFICIENCY

[75] Inventors: Wann-Sheng Huang; Margaret A. Hight, both of Houston, Tex.

[73] Assignee: Texaco Inc., White Plains, N.Y.

[21] Appl. No.: 812,696

[22] Filed: Dec. 23, 1985

[51] Int. Cl.[4] ..... E21B 43/24; E21B 43/30

[52] U.S. Cl. ..... 166/245; 166/50; 166/263; 166/272

[58] Field of Search ..... 166/50, 245, 263, 272

[56] References Cited

U.S. PATENT DOCUMENTS

| | | | |
|---|---|---|---|
| 3,113,618 | 12/1963 | Oakes | 166/245 |
| 4,020,901 | 5/1977 | Pisio et al. | 166/272 X |
| 4,166,501 | 9/1979 | Korstad et al. | 166/263 |
| 4,166,503 | 9/1979 | Hall et al. | 166/263 |
| 4,177,752 | 12/1979 | Brown et al. | 166/272 X |
| 4,249,604 | 2/1981 | Frazier | 166/272 X |
| 4,283,088 | 8/1981 | Tabakov et al. | 299/2 |
| 4,303,126 | 12/1981 | Blevins | 166/245 |
| 4,384,613 | 5/1983 | Owen et al. | 166/256 |
| 4,390,067 | 6/1983 | Willman | 166/245 |
| 4,456,065 | 6/1984 | Heim et al. | 166/248 |

*Primary Examiner*—George A. Suchfield

*Attorney, Agent, or Firm*—Jack H. Park; Kenneth R. Priem; Harold J. Delhommer

[57] ABSTRACT

The disclosed invention is a pattern for recovering hydrocarbons by employing modified inverted 5 spot, modified inverted 9 spot and modified inverted 13 spot well patterns which contain pairs of horizontal wells substituted for the vertical wells drilled at the four corners of the well patterns.

12 Claims, 3 Drawing Figures

HORIZONTAL WELLS AT CORNERS OF VERTICAL WELL PATTERNS FOR IMPROVING OIL RECOVERY EFFICIENCY

BACKGROUND OF THE INVENTION

The invention process is concerned with the enhanced recovery of oil from underground formations. More particularly, the invention relates to a method for recovering hydrocarbons with modified inverted 5 spot, modified inverted 9 spot and modified inverted 13 spot well patterns employing pairs of horizontal wells at the pattern corners instead of single vertical wells.

Horizontal wells have been investigated and tested for oil recovery for quite some time. Although horizontal wells may in the future be proven economically successful to recover petroleum from many types of formations, at present, the use of horizontal wells is usually limited to formations containing highly viscous crude. It seems likely that horizontal wells will soon become a chief method of producing tar sand formations and other highly viscous oils which cannot be efficiently produced by conventional methods because of their high viscosity.

Various proposals have been set forth for petroleum recovery with horizontal well schemes. Most have involved steam injection or in situ combustion with horizontal wells serving as both injection wells and producing wells. Steam and combustion processes have been employed to heat viscous formations to lower the viscosity of the petroleum as well as to provide the driving force to push the hydrocarbons toward a well.

U.S. Pat. No. 4,283,088 illustrates the use of a system of radial horizontal wells, optionally in conjunction with an inverted 9 spot having an unsually large number of injection wells. U.S. Pat. No. 4,390,067 illustrates a scheme of using horizontal and vertical wells together to form a pentagonal shaped pattern which is labeled a "5 spot" in the patent, although the art recognizes a different pattern as constituting a 5 spot.

SUMMARY OF THE INVENTION

The invention is a pattern for recovering hydrocarbons from an underground formation by employing modified inverted 5 spot, modified inverted 9 spot and modified inverted 13 spot well patterns which contain several wells in which at least a portion of the wells extend through the formation in a substantially horizontal direction. Pairs of horizontal wells are substituted for the vertical wells drilled at the four corners of inverted 5 spot, inverted 9 spot and inverted 13 spot well patterns.

DETAILED DESCRIPTION

Although they are more costly and difficult to drill, horizontal wells offer several advantages over vertical wells. One advantage is the increase in direct contact between the wellbore and the pay zone. The perforated interval per vertical well is limited to the pay zone thickness. But for a horizontal well, the perforated interval could be more than ten times that of a vertical wellbore. For example, a 400 foot horizontal well could be run in a 30 foot thick pay zone.

A second advantage of horizontal wells is the ability to complete several horizontal wells from a single location and cover a large drainage area. This is an important advantage when drilling in offshore, Arctic or environmentally sensitive areas where drill site preparation is a major expense. Thirdly, vertical drilling can be uneconomical in very thin pay zone areas. Properly placed horizontal wells can solve this problem. For certain thin formations with a bottom water table, horizontal wells could defer and reduce water coning by providing a low pressure area over a long distance rather than a single low pressure point as with vertical wells.

A fourth advantage is the ability to inject or produce fluids orthogonal to those from a vertical well. This provides potential of improving sweep efficiency of a flood and therefore increasing recovery efficiency.

However, horizontal wells are significantly more expensive to drill than vertical wells. In addition, all existing hydrocarbon reservoirs have vertical wells which have already been drilled in the reservoirs. Thus, ways must be found to coordinate the use of horizontal wells with existing vertical well patterns.

The invention provides a way of achieving horizontal well advantages by using substantially horizontal wells in conjunction with substantially vertical wells for improving oil recovery efficiency. The invention requires that a pair of substantially horizontal wells be drilled at each corner of inverted 5 spot, inverted 9 spot and inverted 13 spot patterns. Each pair of horizontal production wells are drilled to form an X-shaped areal pattern.

Preferably, angles are formed between the horizontal wells in each pair of about 40 degrees to about 140 degrees, most preferably, about 80 degrees to about 100 degrees. Generally, oil recovery efficiency will decrease as the angles between the horizontal wells move further away from 90 degrees. But certain formation characteristics may make it desirable to locate the horizontal wells to form angles other than 90 degrees.

The horizontal wells should be drilled in the bottom third, most preferably, the bottom fifth of the hydrocarbon formation to take full advantage of horizontal well production properties. Preferably, the horizontal wells in each pair are completed at different vertical depths without a communication path between the horizontal wells. However, this is not essential.

Figure 1:
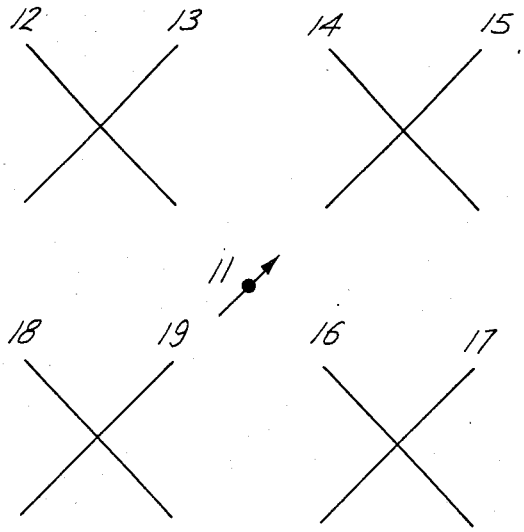
FIG. 1 illustrates the invention well pattern for a modified inverted 5 spot pattern.
Figure 2:
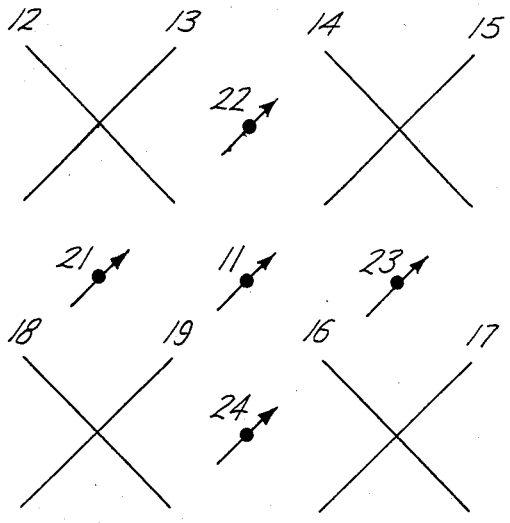
FIG. 2 illustrates the invention well pattern for a modified involved 9 spot pattern.
Figure 3:
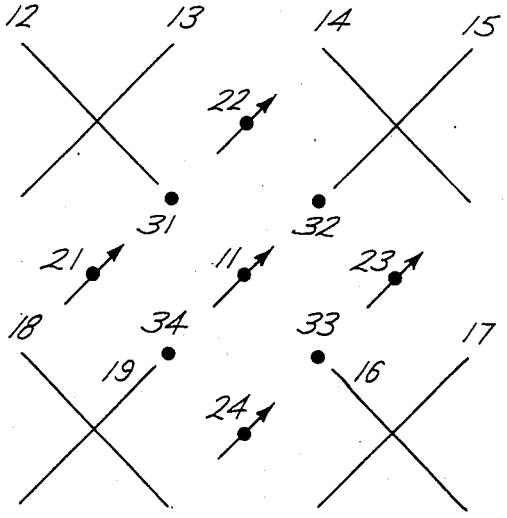
FIG. 3 illustrates the invention well pattern for a modified inverted 13 spot pattern.

FIGS. 1, 2 and 3 diagram the invention drilling and production patterns. In all three figures, wells 12, 13, 14, 15, 16, 17, 18 and 19 are horizontal production wells drilled at the corners of the modified inverted 5 spot, modified inverted 9 spot and modified inverted 13 spot patterns of FIGS. 1, 2 and 3, respectively. Well 11 is the substantially vertical central injection well. For some patterns, particularly patterns covering a large area, it may be desirable to substitute several vertical injection wells for the single injection well 11 and locate the plural central injectors near the center of the pattern.

Wells 21, 22, 23 and 24 are injection side wells. Under some operations, these side wells may also be production wells or a mixture of injection and production wells. Wells 31, 32, 33 and 34 of FIG. 3 are infill wells. The infill wells 31–34 are normally used as production wells, but under some operational procedures, may be converted to injection wells as is well known in the art.

Simulation results indicate that the use of horizontal wells in conjunction with vertical wells according to the invention are highly effective in recovering oil, particularly oil from blind spot areas in mature steam floods. The horizontal wells speed oil recovery and thus, shorten project lives. Although the invention method may be practiced in most hydrocarbon reservoirs, production economics will probably limit its use to thermal recovery in heavy oil reservoirs for the next few years.

Horizontal wells must extend from the surface and run a substantially horizontal distance within the hydrocarbon formation. The diameter and length of the horizontal wells in their perforation intervals are not critical, except that such factors will affect the well spacing and the economics of the process. Perforation size will be a function of factors such as flow rate, temperatures and pressures employed in a given operation. Such decisions should be determined by conventional drilling criteria, the characteristics of the specific formation, the economics of a given situation, and the well known art of drilling horizontal wells.

The following examples will illustrate the invention. They are given by way of illustration and not as limitations on the scope of the invention. Thus, it should be understood that a process can be varied from the description and the examples and still remain within the scope of the invention.

EXAMPLES

A commercially available 3-dimensional numerical simulator developed for thermal recovery operations was employed for the examples. The model used was "Combustion and Steamflood Model-THERM" by Scientific Software-Intercomp. The model accounts for three phase flow described by Darcy's flow equation and includes gravity, viscous and capillary forces. Heat transfer is modeled by conduction and convection. Relative permeability curves are temperature dependent. The model is capable of simulating well completions in any direction (vertical, horizontal, inclined or branched).

Reservoir properties used in the study are typical of a California heavy oil reservoir with unconsolidated sand. A dead oil with an API gravity of 13 degrees was used in the simulation. The assumed reservoir properties are listed in Table 1.

EXAMPLE 1

An 18.5 acre (7.5 ha) inverted 9 spot pattern was used as a basis for this simulation study. The 125-foot (38-m) thick formation is divided into five equal layers. All wells were completed in the lower 60% of the oil sand. Steam at 65% quality was injected into the central well at a constant rate of 2400 BPD (381 $m^3/d$) cold water equivalent. The project was terminated when the fuel required to generate steam was equivalent to the oil produced from the pattern or instantaneous steam-oil ratio (SOR) of 15. A maximum lifting capacity of 1000 BPD (159 $m^3/d$) was assumed for each producing well.

The resulting oil recovery at the end of the project life (15 years) was 64.7% of the original oil in place. The predicted oil saturation profile indicates a good steam sweep throughout the upper three layers to an oil saturation less than 0.2 (the upper 60% of the oil zone), but steam bypassed most of the lower two layers except near the injection well.

EXAMPLE 2

Infill wells were added to the simulation grid midway between center and corner wells to form an inverted 13 spot pattern. The wells were completed in the lower one-third of the zone only and infill production began after three years of steam injection and continued to the end of the project.

Ultimate recovery was 63.2% of the original oil in place after 11 years. Note that the advantage of infill wells is to recover oil sooner. For the inverted 9 spot pattern of Ex. 1, the oil recovery at 11 years would have been only 57% at this time. Because of the presence of infill wells, oil production which would otherwise arrive at corner and side wells will be reduced. As a result, the inverted 13 spot pattern would reach economic limit much sooner than an inverted 9 spot pattern unless other operational changes are made.

The oil saturation profile for Example 2 is about the same as for Ex. 1, but is reached four years sooner than in Ex. 1. There is still a high oil saturation region in the area between the corner and side wells.

EXAMPLE 3

The modified inverted 9 spot of FIG. 2 was simulated and compared with the base cases of Examples 1 and 2. This configuration has three vertical injection wells and two horizontal producers per pattern. The run was carried out with an 18.5 acre (7.5-ha) pattern and an injection rate of 3900 BPD (620 $m^3/d$) or 1.7 BPD per acre foot. Vertical wells were completed in the lower three layers of the simulation grid only and all horizontal wells were completed in the bottom (fifth layer) of the simulation grid. The horizontal wells had a length of 635 feet and a diameter of six inches. They extended towards the central injection well for a distance of about 318 feet from the corner position of the pattern, which was about half the distance from the corner wells to the central well. 90 degree angles were formed between the crossed horizontal wells.

Ultimate recovery was 72.2% of the original oil in place at the end of a seven year project life and 1.4 pore volumes of steam injection. After only seven years, the average oil saturation was 15% in the upper 60% of the oil zone and 26% of the lower 40%. The areal and vertical conformance were good and only minimum steam override had occurred.

EXAMPLE 4

A conversion to hot water injection after seven years of central well injection for Example 3 was made and the results indicated the ultimate oil recovery could reach 74.7% at 10 years. An average oil saturation in the lower 40% of the oil zone could be reduced to 21%, compared to the 26% of Example 3.

Many variations of the method of this invention will be apparent to those skilled in the art from the foregoing discussion and examples. Variations can be made without departing from the scope and spirit of the following claims. t,0120

What is claimed is:

1. A modified inverted 9 spot well pattern, for recovering hydrocarbons from an underground formation, which comprises:

a pair of substantially horizontal production wells at each of the four corners of the pattern, said horizontal production wells extending from the ground surface and running a substantially horizontal distance within the hydrocarbon formation, each pair of horizontal wells forming an x-shaped areal pattern; and a substantially vertical central injection well.

2. The hydrocarbon recovery method of claim 1, wherein the horizontal wells are completed in the bottom third of the hydrocarbon formation.

3. The hydrocarbon recovery method of claim 1, wherein the horizontal wells forming each pair of wells are at different vertical depths without a communication path between the horizontal wells in each pair of wells.

4. The hydrocarbon recovery method of claim 1, wherein the horizontal wells forming each pair of wells are completed at approximately the same vertical depths so that the wells communicate with each other.

5. The hydrocarbon recovery method of claim 1, wherein angles between about 40 degrees to about 140 degrees are found between each of the horizontal wells in each pair of wells.

6. The pattern of claim 1, wherein side wells are injection wells.

7. The hydrocarbon recovery method of claim 1, further comprising additional substantially vertical central injection wells.

8. A modified inverted 9 spot well pattern for recovering hydrocarbons from an underground formation, which comprises:

a pair of substantially horizontal production wells at each of the four corners of the pattern, said horizontal production wells extending from the ground surface and running a substantially horizontal distance within the hydrocarbon formation, each pair of horizontal wells forming an x-shaped areal pattern with angles between about 80 degrees to about 100 degrees formed between each of the horizontal wells in each pair of wells, said horizontal wells being completed in the bottom third of the formation without a communication path between the horizontal wells in each pair of wells; and a substantially vertical central injection well.

9. A modified inverted 5 spot well pattern for recovering hydrocarbons from an underground formation, which comprises:

a pair of substantially horizontal production wells at each of the four corners of the pattern, said horizontal production wells extending from the ground surface and running a substantially horizontal distance within the hydrocarbon formation, each pair of horizontal wells forming an x-shaped areal pattern; and a substantially vertical central injection well.

10. A modified inverted 5 spot well pattern for recovering hydrocarbons from an underground formation, which comprises:

a pair of substantially horizontal production wells at each of the four corners of the pattern, said horizontal production wells extending from the ground surface and running a substantially horizontal distance within the hydrocarbon formation, each pair of horizontal wells forming an x-shaped areal pattern with angles between about 80 degrees to about 100 degrees formed between each of the horizontal wells in each pair of wells, said horizontal wells being completed in the bottom third of the formation without a communication path between the horizontal wells in each pair of wells; and a substantially vertical central injection well.

11. A modified inverted 13 spot well pattern for recovering hydrocarbons from an underground formation, which comprises:

a pair of substantially horizontal production wells at each of the four corners of the pattern, said horizontal production wells extending from the ground surface and running a substantially horizontal distance within the hydrocarbon formation, each pair of horizontal wells forming an x-shaped areal pattern; and a substantially vertical central inejction well.

12. A modified inverted 13 spot well pattern for recovering hydrocarbons from an underground formation, which comprises:

a pair of substantially horizontal production wells at each of the four corners of the pattern, said horizontal production wells extending from the ground surface and running a substantially horizontal distance within the hydrocarbon formation, each pair of horizontal wells forming an x-shaped areal pattern with angles between about 80 degrees to about 100 degrees formed between each of the horizontal wells in each pair of wells, said horizontal wells being completed in the bottom third of the formation without a communication path between the horizontal wells in each pair of wells; and a substantially vertical central injection well.

* * * * *

UNITED STATES PATENT AND TRADEMARK OFFICE

CERTIFICATE OF CORRECTION

PATENT NO. : 4,662,441

DATED : May 5, 1987

INVENTOR(S) : Wann-Sheng Huang and Margaret Anne Hight

It is certified that error appears in the above-identified patent and that said Letters Patent is hereby corrected as shown below:

In Col. 5 the first phrase of Claims 2, 3, 4, 5, and 7 should read --The pattern of Claim 1,-- instead of "The hydrocarbon recovery method of Claim 1".

In Col. 6, line 33, the fifth word should read --injection-- instead of "inejction".

Signed and Sealed this

Twenty-fifth Day of August, 1987

*Attest:*

DONALD J. QUIGG

*Attesting Officer*

*Commissioner of Patents and Trademarks*